US011240881B2

(12) United States Patent
Wallinger et al.

(10) Patent No.: US 11,240,881 B2
(45) Date of Patent: Feb. 1, 2022

(54) METHOD OF MANUFACTURING AND ADJUSTING A RESISTIVE HEATER

(71) Applicant: Watlow Electric Manufacturing Company, St. Louis, MO (US)

(72) Inventors: Martin Wallinger, Abtenau (AT); Sanhong Zhang, Ballwin, MO (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 348 days.

(21) Appl. No.: 16/377,903

(22) Filed: Apr. 8, 2019

(65) Prior Publication Data

US 2020/0323039 A1 Oct. 8, 2020

(51) Int. Cl.
*H05B 3/00* (2006.01)

(52) U.S. Cl.
CPC ..... *H05B 3/0019* (2013.01); *H05B 2203/017* (2013.01)

(58) Field of Classification Search
CPC .. H05B 3/0014; H05B 3/0019; H05B 3/0023; H05B 2203/017
See application file for complete search history.

(56) References Cited

U.S. PATENT DOCUMENTS 5,576,553 A 11/1996 Adachi
6,048,402 A 4/2000 Okuno et al.
6,329,272 B1 12/2001 Gagnon et al.
6,897,414 B2 * 5/2005 Ito ..... H05B 3/265 219/444.1
6,924,464 B2 8/2005 Zhou et al.
6,967,312 B2 11/2005 Hiramatsu et al.
7,211,772 B2 * 5/2007 Carpino, II ..... H05B 3/36 219/528
7,361,865 B2 4/2008 Maki et al.
7,705,276 B2 4/2010 Giddings et al.
(Continued)

FOREIGN PATENT DOCUMENTS

CN 106198602 A * 12/2016
EP 0546495 6/1993
(Continued)

OTHER PUBLICATIONS

Search Report in corresponding TW Application 109111654, dated Mar. 3, 2021.
(Continued)

*Primary Examiner* — Peter Dungba Vo
*Assistant Examiner* — Jeffrey T Carley
(74) *Attorney, Agent, or Firm* — Burris Law, PLLC

(57) ABSTRACT

A method of adjusting a watt density distribution of a resistive heater includes designing a baseline heater circuit. A detection circuit is designed having a constant trace watt density and the detection circuit overlaps the baseline heater circuit. The detection circuit is manufactured, and its baseline thermal map is obtained. The baseline heater circuit is manufactured, and a nominal thermal map is obtained. A subsequent detection circuit is manufactured, and an actual thermal map is obtained. A subtraction thermal image is created by subtracting the baseline thermal map from the actual thermal map, and a subsequent baseline heater circuit is modified according to the subtraction thermal image.

20 Claims, 8 Drawing Sheets

(56) References Cited

U.S. PATENT DOCUMENTS

| | | | | |
|---|---|---|---|---|
| 7,777,160 | B2 | 8/2010 | Fan et al. | |
| 7,902,485 | B2 | 3/2011 | Jyousaka et al. | |
| 7,939,784 | B2 | 5/2011 | Steger et al. | |
| 8,168,050 | B2 | 5/2012 | Lu | |
| 8,786,396 | B2 * | 7/2014 | Leung | H01L 28/20 338/25 |
| 10,841,980 | B2 * | 11/2020 | Sajic | H05B 3/145 |
| 10,960,983 | B2 * | 3/2021 | Paulson | H05B 3/20 |
| 2004/0055699 | A1 * | 3/2004 | Smith | B29C 65/3468 156/273.9 |
| 2004/0075528 | A1 * | 4/2004 | Carbin | H05K 1/167 338/307 |
| 2005/0199610 | A1 | 9/2005 | Ptasienski et al. | |
| 2009/0152259 | A1 * | 6/2009 | Fan | H01L 21/67103 219/444.1 |
| 2015/0055940 | A1 | 2/2015 | Steinhauser | |
| 2016/0221680 | A1 * | 8/2016 | Burton | H05B 3/34 |
| 2016/0240366 | A1 | 8/2016 | Engelhardt et al. | |
| 2017/0022630 | A1 | 1/2017 | Lu et al. | |
| 2017/0052142 | A1 * | 2/2017 | Watanabe | H05B 3/265 |
| 2017/0086259 | A1 * | 3/2017 | Du | H05B 3/34 |
| 2017/0167790 | A1 | 6/2017 | Gaff et al. | |

FOREIGN PATENT DOCUMENTS

| | | |
|---|---|---|
| EP | 0613780 | 9/1994 |
| WO | 2018151931 | 8/2018 |

OTHER PUBLICATIONS

International Search Report for International Application PCT/US2020/027087, dated Jul. 10, 2020.

* cited by examiner

METHOD OF MANUFACTURING AND ADJUSTING A RESISTIVE HEATER

FIELD

The present disclosure relates to the manufacture of resistive heaters and methods to compensate for material and manufacturing variations.

BACKGROUND

The statements in this section merely provide background information related to the present disclosure and may not constitute prior art.

Layered heater assemblies generally include a substrate, a dielectric layer disposed on the substrate, and a resistive heating layer disposed on the dielectric layer, among other layers. For example, a protective layer may be disposed over the resistive heating layer. Further, there may be multiple dielectric layers and multiple resistive heating layers. The dielectric layer, resistive heating layer, protective layer, and other layers together are generally referred to as a layered heater. Further, there may be one or more layered heaters in any given assembly, and the layered heater may or may not include the dielectric or protective layer, depending on a material of the substrate (e.g., if the substrate is nonconductive) and the operational environment.

Layered heaters may be processed by "thick" film, "thin" film, or "thermal spray," among other types, wherein the primary difference between these types of layered heaters is the method in which the layers are formed. For example, the layers for thick film heaters are typically formed using processes such as screen printing, decal application, or film dispensing heads, by way of not-limiting example. The layers for thin film heaters, on the other hand, are typically formed using deposition processes such as ion plating, sputtering, chemical vapor deposition (CVD), and physical vapor deposition (PVD), by way of not limiting examples. A third series of processes for forming layered heaters, thermal spraying processes, include by way of not-limiting example flame spraying, atmospheric plasma spraying (APS), suspension atmospheric plasma spraying (SAPS), wire arc spraying, cold spray, low pressure plasma spray (LPPS), high velocity oxygen fuel (HVOF), and suspension high velocity oxygen fuel (SHVOF). Yet another way in which layered heaters may be processed are by sol gel processes.

On a microscopic scale, the deposited layers may have uneven surfaces, or a variable geometry, for many reasons, such as trenches in the substrate and manufacturing tolerances associated with the method of forming the resistive layer, or other layers. As a result, the sheet resistance of the overall layered heater may not be uniform from heater assembly to heater assembly. Generally, sheet resistance refers to the resistance along a plane of the resistive layer due to the relatively thin nature of the resistive material being applied, versus resistance perpendicular to the resistive material. Lack of uniformity of sheet resistance of the layered heater can unpredictably alter the electrical resistance the layered heater, which can inhibit the heater in achieving an intended thermal distribution. Further, a desired thermal distribution may be inhibited by local bonding/adhesion irregularities of the various layers as well as irregularities in the substrate, among other assembly/system irregularities.

Under conventional methods, patterns or "traces" of the resistive layer are designed using computational analysis tools that determine the electrical wattage distribution needed from the layered heater to produce a desired thermal profile. Circuit geometry and a nominal sheet resistance value are input to an analysis model. In some applications, resistive layer traces include segments with different widths in order to optimize the wattage distribution. If the analysis model predicts an unsatisfactory thermal distribution, the segment widths, along with the overall trace geometry can be adjusted to achieve a target thermal distribution.

To manufacture the designed resistive trace, a variety of patterning processes may be employed. Examples of patterning processes for layered heaters can include chemical etching, dry etching, and CNC (computer numerical control) material removal processes such as machining and laser ablation. Even with highly precise manufacturing methods, variations in resistance along/throughout segments of the resistive trace can occur from manufacturing batch to manufacturing batch.

These variations, including the variation of sheet resistance of the resistive heating layer, variations in layer-to-layer interfaces, variations in the substrate, and assembly/system variations is addressed by the teachings of the present disclosure.

SUMMARY

According to one form, a method of adjusting a watt density distribution of a resistive heater includes designing a baseline heater circuit. A detection circuit is designed having a constant trace watt density and the detection circuit overlaps the baseline heater circuit and includes a margin. The detection circuit is manufactured by a selective removal process. Power is applied to the detection circuit and a baseline thermal map is obtained. The baseline heater circuit is manufactured from the detection circuit by a selective removal process. Power is applied to the baseline heater circuit and a nominal thermal map is obtained. The steps of manufacturing the detection circuit by a selective removal process, applying power to the detection circuit and obtaining a baseline thermal map, manufacturing the baseline heater circuit from the detection circuit by a selective removal process, and applying power to the baseline heater circuit and obtaining a nominal thermal map is repeated to achieve a desired temperature profile along the target surface. After achieving the desired temperature profile, a subsequent detection circuit is manufactured by a selective removal process. Power is then applied to the subsequent detection circuit and an actual thermal map is obtained. A subtraction thermal image is created by subtracting the baseline thermal map from the actual thermal map. A subsequent baseline heater circuit is modified according to the subtraction thermal image.

According to another form, the steps of manufacturing a subsequent detection circuit by a selective removal process, applying power to the subsequent detection circuit to obtain an actual thermal map, creating a subtraction thermal image by subtracting the baseline thermal map from the actual thermal map, and modifying a subsequent baseline heater circuit according to the thermal image may be carried out for a desired number "n" heaters.

In one form, the margin is between about 1% to about 50% of the trace width of the baseline heater circuit. In another form, the margin is between about 10% to about 20%.

According to one form, the modification is accomplished by changing the trace width of the subsequent baseline heater circuit, by changing the thickness of the subsequent baseline heater circuit, by modifying a specific resistivity of the subsequent baseline heater circuit (for example, by modifying a microstructure of the subsequent baseline heater circuit through a heat treatment process, such as adding local oxides by a laser process), by adding different materials to segments of the subsequent baseline heater circuit, among others, and combinations thereof.

In a variety of forms, the thermal map is obtained by an IR camera; the trimming is achieved by at least one of laser ablation, mechanical ablation, and a hybrid waterjet; and the heater is formed by thermal spraying In another form, the circuits are selected from the group consisting of layered, foil, and wire circuits.

In another form of the present disclosure, a method for adjusting a watt density distribution of a resistive heater includes designing a baseline heater circuit. A detection circuit having a constant trace watt density is designed, and the detection circuit overlaps the baseline heater circuit and includes a margin. The detection circuit is then manufactured. Power is then applied to the detection circuit, where a baseline thermal map is obtained. The baseline heater circuit is then manufactured from the detection circuit. Power is applied to the baseline heater circuit and a nominal thermal map is obtained. The baseline heater circuit is assembled to a thermal device, and power is applied to the baseline heater circuit to obtain a thermal map of a target surface. The steps of manufacturing the detection circuit, applying power to the detection circuit and obtaining a baseline thermal map, manufacturing the baseline heater circuit from the detection circuit, applying power to the baseline heater circuit and obtaining a nominal thermal map, assembling the baseline heater circuit to a thermal device, and applying power to the baseline heater circuit and obtaining a thermal map of a target surface are repeated as necessary to achieve a desired temperature profile. A subsequent detection circuit is then manufactured, and power is applied to the subsequent detection circuit to obtain an actual thermal map. A subtraction thermal image is created by subtracting the baseline thermal map from the actual thermal map. The subsequent baseline heater circuit is modified according to the subtraction thermal image.

According to a variation, at least one of the detection circuit and the subsequent detection circuit are manufactured using a selective removal process.

According to another variation, at least one of the baseline heater circuit and the subsequent baseline heater circuit are manufactured using a selective removal process. In yet other variations, the subsequent baseline heater circuit is modified by a selective removal process.

In a variation, the steps of manufacturing a subsequent detection circuit, applying power to the subsequent detection circuit and obtaining an actual thermal map, creating a subtraction thermal image by subtracting the baseline thermal map from the actual thermal map, and modifying a subsequent baseline heater circuit according to the subtraction thermal image are repeated for "n" number of heaters.

According to a variation, a plurality of heater assemblies may be manufactured according to the steps of the instant disclosure.

According to yet another variation, the circuits are formed by thermal spraying. The circuits may be selected from the group consisting of layered, foil, and wire circuits.

According to yet another variation of the present disclosure, a method of adjusting a watt density distribution of a resistive heater includes manufacturing a detection circuit. Power is then applied to the detection circuit and a baseline thermal map is obtained. A baseline heater circuit is manufactured from the detection circuit. Power is then applied to the baseline heater circuit and a nominal thermal map is obtained. The baseline heater circuit is assembled to a thermal device. Power is applied to the baseline heater circuit and a thermal map of a target surface is obtained. The steps of manufacturing the detection circuit, applying power to the detection circuit and obtaining a baseline thermal map, manufacturing a baseline heater circuit from the detection circuit, applying power to the baseline heater circuit and obtaining a nominal thermal map, assembling the baseline heater circuit to a thermal device, and applying power to the baseline heater circuit and obtaining a thermal map of a target surface are repeated to achieve a desired temperature profile along the target surface. After, a subsequent detection circuit is manufactured. Power is applied to the subsequent detection circuit and an actual thermal map is obtained. A subtraction thermal image is created by subtracting the baseline thermal map from the actual thermal map. The subsequent baseline heater circuit is modified according to the subtraction thermal image.

In a variation, at least one of the circuits is manufactured or modified by a selective removal process.

In yet another variation, the circuits are formed by thermal spraying.

In a further variation, the circuits are selected from the group consisting of layered, foil, and wire circuits.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
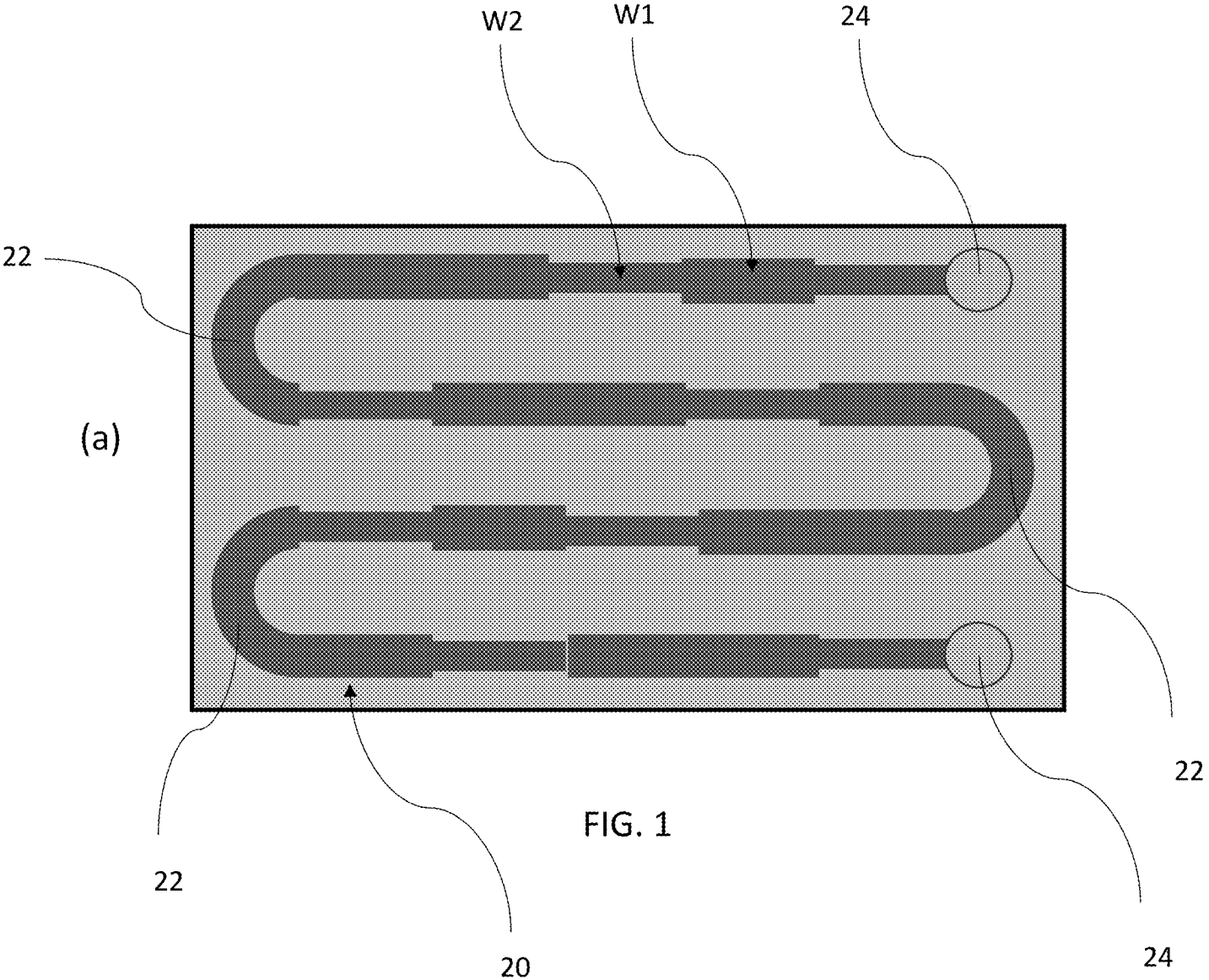
FIG. 1 is a plan view of a baseline heater circuit according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides a method of adjusting a watt density of a resistive heater, including by way of example, a layered heater. A more detailed description of this form of heater is provided in U.S. Pat. Nos. 8,680,443, 7,132,628, 7,342,206, and 7,196,295, which are commonly assigned with the present application and the contents of which are incorporated by reference herein in their entireties. The method may also be employed with a variety of types of heaters other than "layered" heaters, including by way of example, foil heaters and resistive wire heaters. Accordingly, the methods disclosed herein may be employed with any type of resistive heater construction while remaining within the scope of the present disclosure and the term "layered" should not be construed as limiting.

Referring to FIG. 1, a method in accordance with the teachings of the present disclosure begins with designing a baseline heater circuit 20 at step (a), which is a nominal design that has been analytically optimized to provide a specific thermal profile, which in one form is a uniform thermal profile, to a target. (These heater circuits are commonly referred to as "resistive traces" and include a path along which a resistive heating material or element traverses).

As shown, the example baseline heater circuit 20 includes segments that are wider and segments that are more narrow, which provide a tailored watt density along the length of the baseline heater circuit 20. For example, the baseline heater circuit 20 includes segments of its trace W1 that provide a lower watt density (wider), while segments of its trace W2 (narrower) provide a higher watt density. The baseline heater circuit 20 also includes bend segments 22, which are generally wider to inhibit current crowding, along with terminations 24 for connection to a power source (not shown). It should be understood that this illustrated serpentine pattern is merely exemplary, and any shape trace (such as segments designed to be connected in electrical parallel) for the baseline heater circuit 20 could result from design efforts, depending on the application and its thermal requirements.

Figure 2:
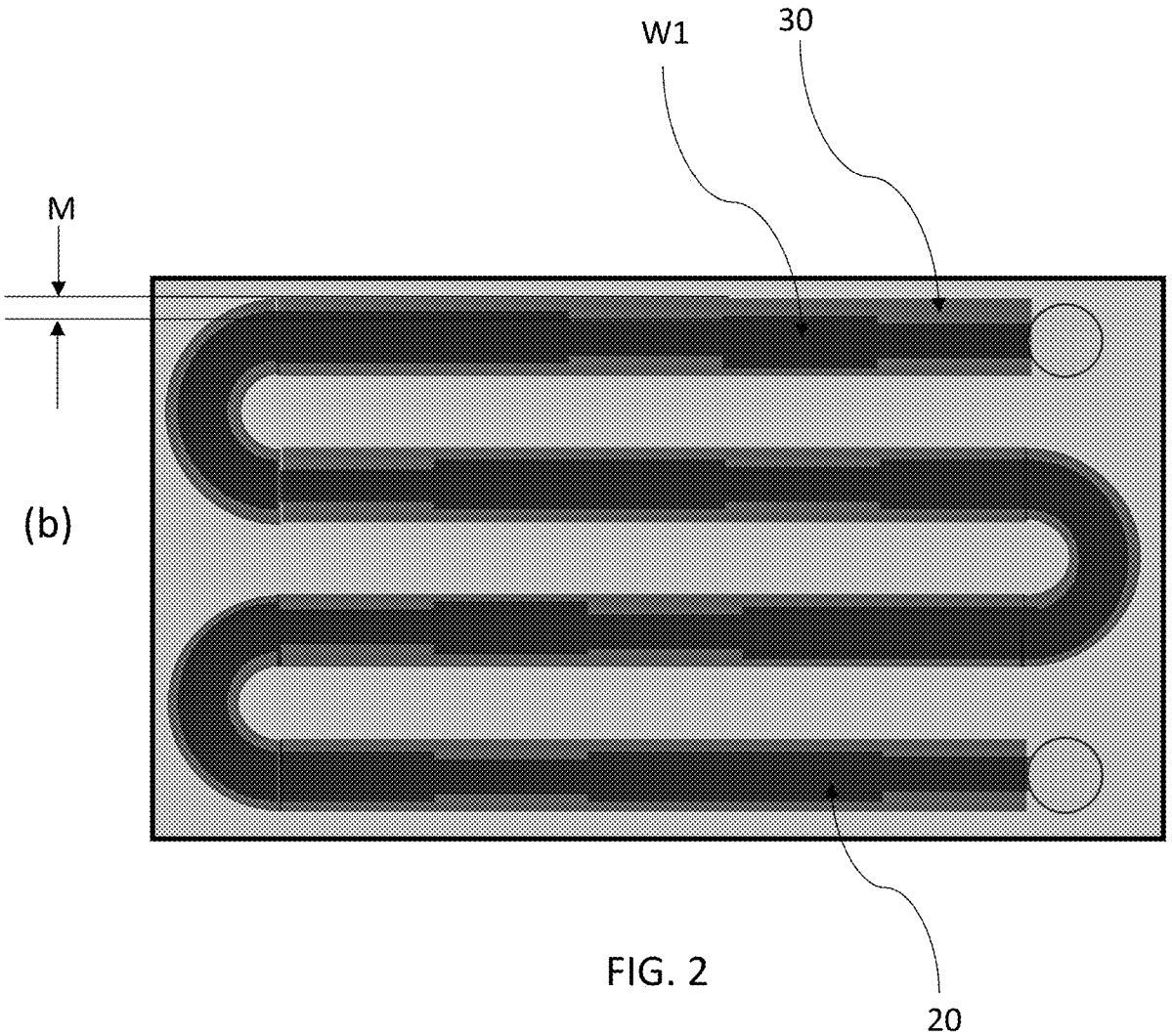
FIG. 2 is a plan view of a detection circuit overlapping the baseline heater circuit of FIG. 1 according to the present disclosure.

Referring to FIG. 2, the method next includes step (b) of designing a detection circuit 30 having a constant trace watt density, wherein this detection circuit 30 overlaps the baseline circuit 20 by a margin, which is variable by virtue of the variable width of the baseline heater circuit. However, in one form, the margin is no greater than about 1-50% of the largest width of the baseline heater circuit 20 trace. For example, if W1 is 1.0 mm, the margin M is between 0.1 mm and 0.5 mm. In another form, the margin is no greater than about 10-20%. It should be understood, however, that other margins may be employed depending on the construction of the resistive heater and the application and the values disclosed herein should not be construed as limiting the scope of the present disclosure.

The constant trace watt density of the detection circuit 30 is provided by the trace being a constant width and a constant thickness, but it should be understood that other approaches to achieving a constant trace watt density may be employed while remaining within the scope of the present disclosure. For example, a trace that becomes narrower while becoming thicker may also provide a constant trace watt density.

Figure 3A:
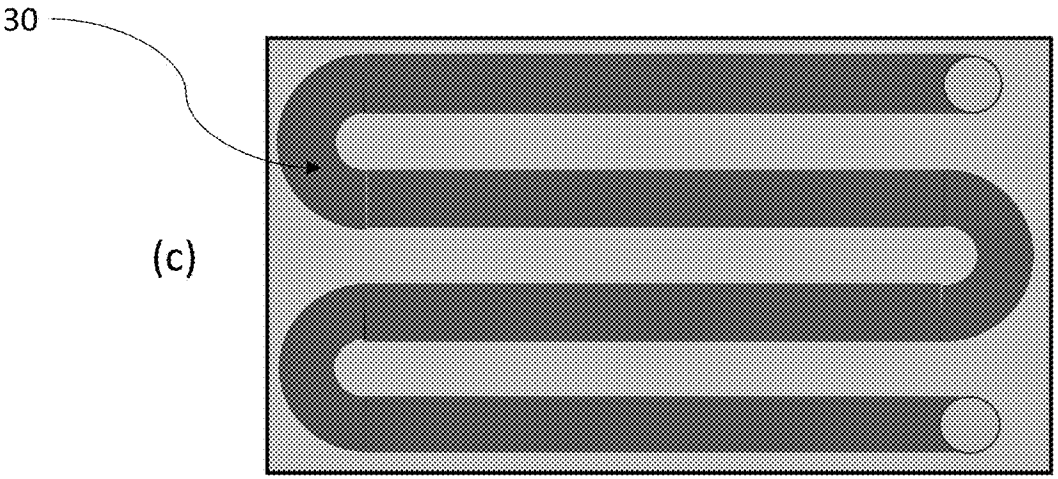
FIG. 3A is a plan view of a manufactured detection circuit of FIG. 2 according to the present disclosure.

Referring to FIG. 3A, the method next includes step (c) of manufacturing the detection circuit 30, for example by using a selective removal process after a resistive material has been applied to a substrate. The resistive material may be applied, for example, by any layered process such as thermal spraying. Alternatively, the resistive material may be a foil or a conductive wire while remaining within the scope of the present disclosure. The selective removal process may include, by way of example, laser ablation, mechanical ablation, or hybrid waterjet (laser and waterjet), among others. However, the detection circuit 30 may be manufacturing by other methods such as printing or masking, among others, and thus the selective removal process for manufacturing the detection circuit 30 should not be construed as limiting the scope of the present disclosure.

Figure 3B:
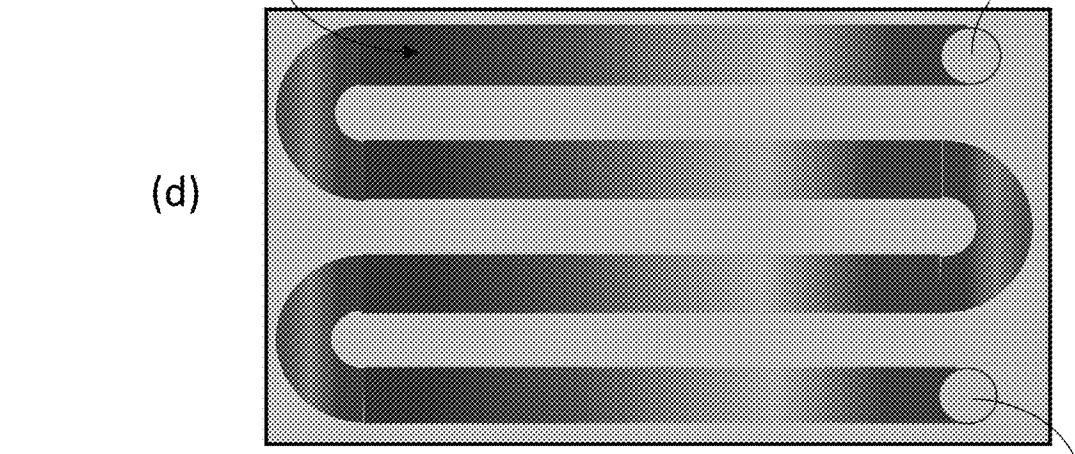
FIG. 3B is a plan view of a baseline thermal map of the manufactured detection circuit of FIG. 3A according to the present disclosure.

As shown in FIG. 3B, once the detection circuit 30 is manufactured, method proceeds to step (d), where power is applied to the detection circuit (e.g., by applying power to the terminations 24) to obtain a baseline thermal map 40. The baseline thermal map can be obtained using an IR camera. When the use of a two-wire controller to obtain thermal images is contemplated, such a process is shown and described in greater detail in U.S. Pat. No. 7,196,295, which is commonly assigned with the present application and the contents of which are incorporated by reference in their entirety. The baseline thermal map may be stored, e.g., in a memory.

Figure 4A:
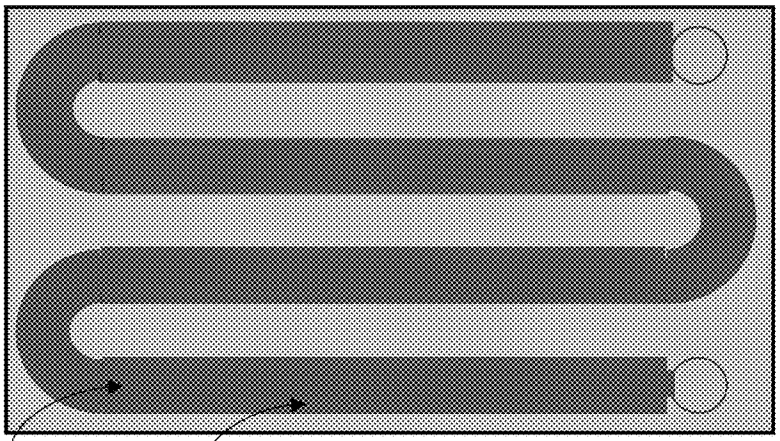
FIG. 4A is a plan view of a baseline heater circuit manufactured from the detection circuit of FIG. 3A.

Referring to FIG. 4A, the baseline heater circuit 20 is manufactured from the detection circuit 30 in step (e). In one form, the baseline heater circuit 20 is manufactured by a selective removal process. The selective removal processes noted above to manufacture the detection circuit 30 may also be used to manufacture the baseline heater circuit 20. It should also be noted that the selective removal process to manufacture the baseline heater circuit 20 need not be the same as that used to manufacture the detection circuit 30.

Figure 4B:
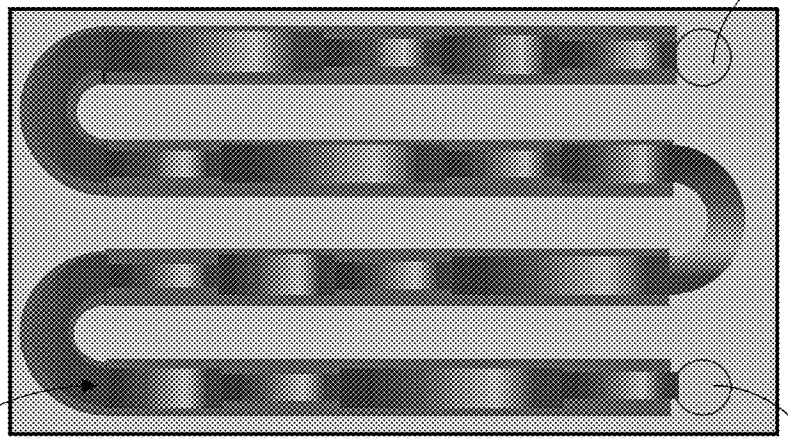
FIG. 4B is a plan view of a nominal thermal map of the manufactured baseline heater circuit of FIG. 4A.

Referring to FIG. 4B, after manufacturing the baseline heater circuit 20, power is applied to the baseline heater circuit 20 (e.g., by applying power to the terminations 24) to obtain a nominal thermal map 50 in step (f). The nominal thermal map 50 can be obtained using an IR (infrared) camera. The nominal thermal map may be stored, e.g., in memory on a microprocessor of a computing device (not shown).

Figure 5:
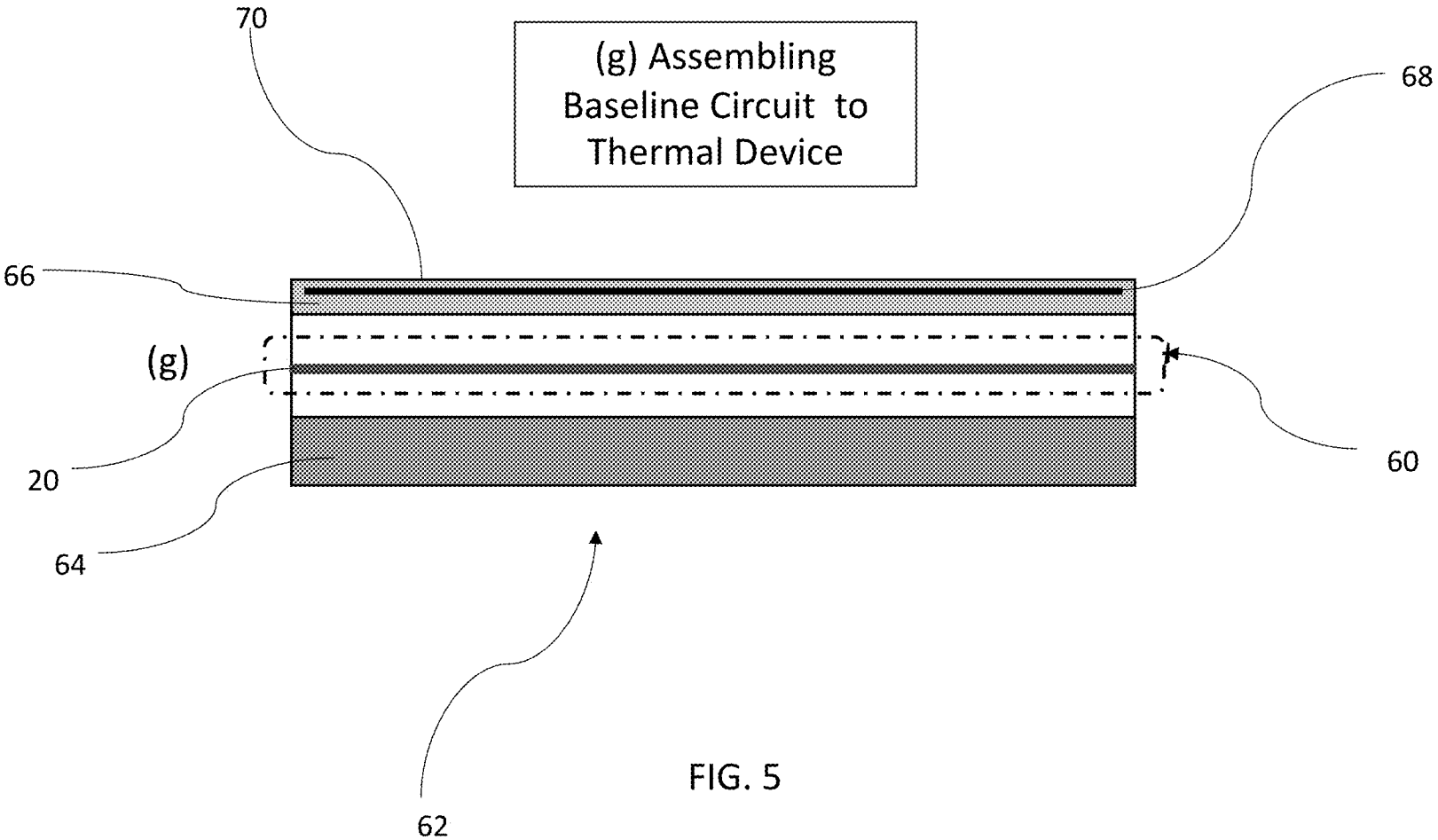
FIG. 5 is a cross-sectional view of the baseline heater circuit of FIG. 4A assembled to a thermal device according to the teachings of the present disclosure.

Referring now to FIG. 5, the baseline heater circuit 20 is assembled to a thermal device 60 at step (g). By way of example, the baseline heater circuit 20 is shown disposed within a thermal device that is a chuck device 62, which includes a chill plate 64 and a ceramic puck 66 having an electrode 68 embedded therein. The ceramic puck 66 includes a target surface 70 as shown, which is generally where a substrate is placed for etching during operation of the chuck device 62. It should be understood that this chuck device 62 is merely exemplary and that the methods according to the present disclosure may be employed in any number of applications where adjusting sheet resistivity of a resistive heater circuit would be advantageous.

Figure 6:
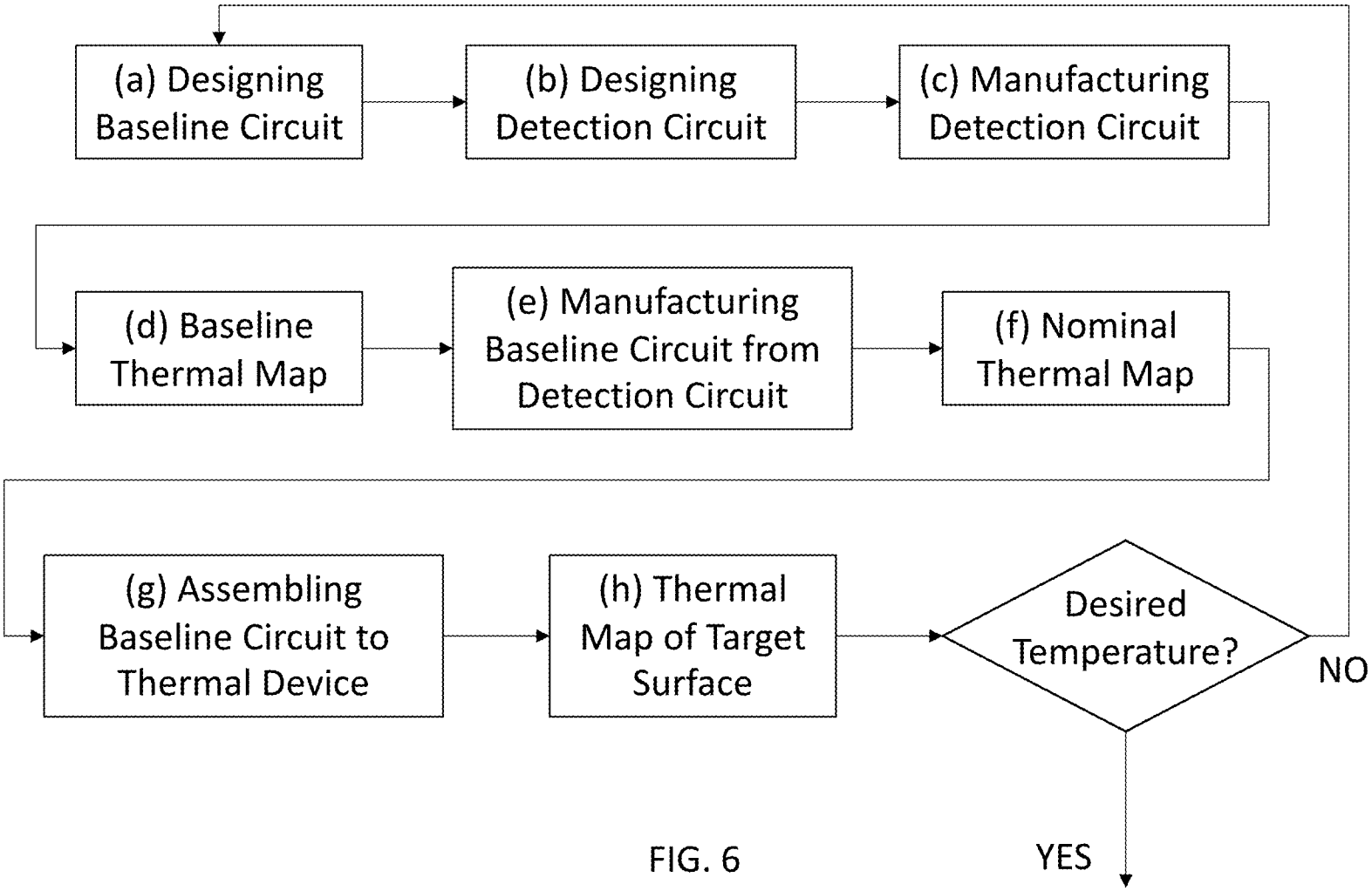
FIG. 6 is a flow diagram illustrating the steps in FIGS. 1 through 5, which are repeated as necessary to achieve a desired temperature profile.

After assembly, and with reference to FIG. 6 for the steps as set forth above, power is applied to the baseline heater circuit 20 at step (h) to obtain a thermal map of the target surface 70. Similar to the thermal images described above, the thermal map of the target surface 70 can be obtained using an IR camera. The thermal map of the target surface may be stored, e.g., in memory on a microprocessor of a computing device (not shown).

The thermal map of the target surface 70 is analyzed to determine whether the target surface exhibits a desired temperature profile along the target surface 70. If not, as further shown in FIG. 6, steps (a) through (h) are repeated until the desired temperature profile is achieved. In one form, the method may terminate after a pre-determined number of repeated steps (a) through (h) even if the temperature profile is not achieved.

Figure 7:
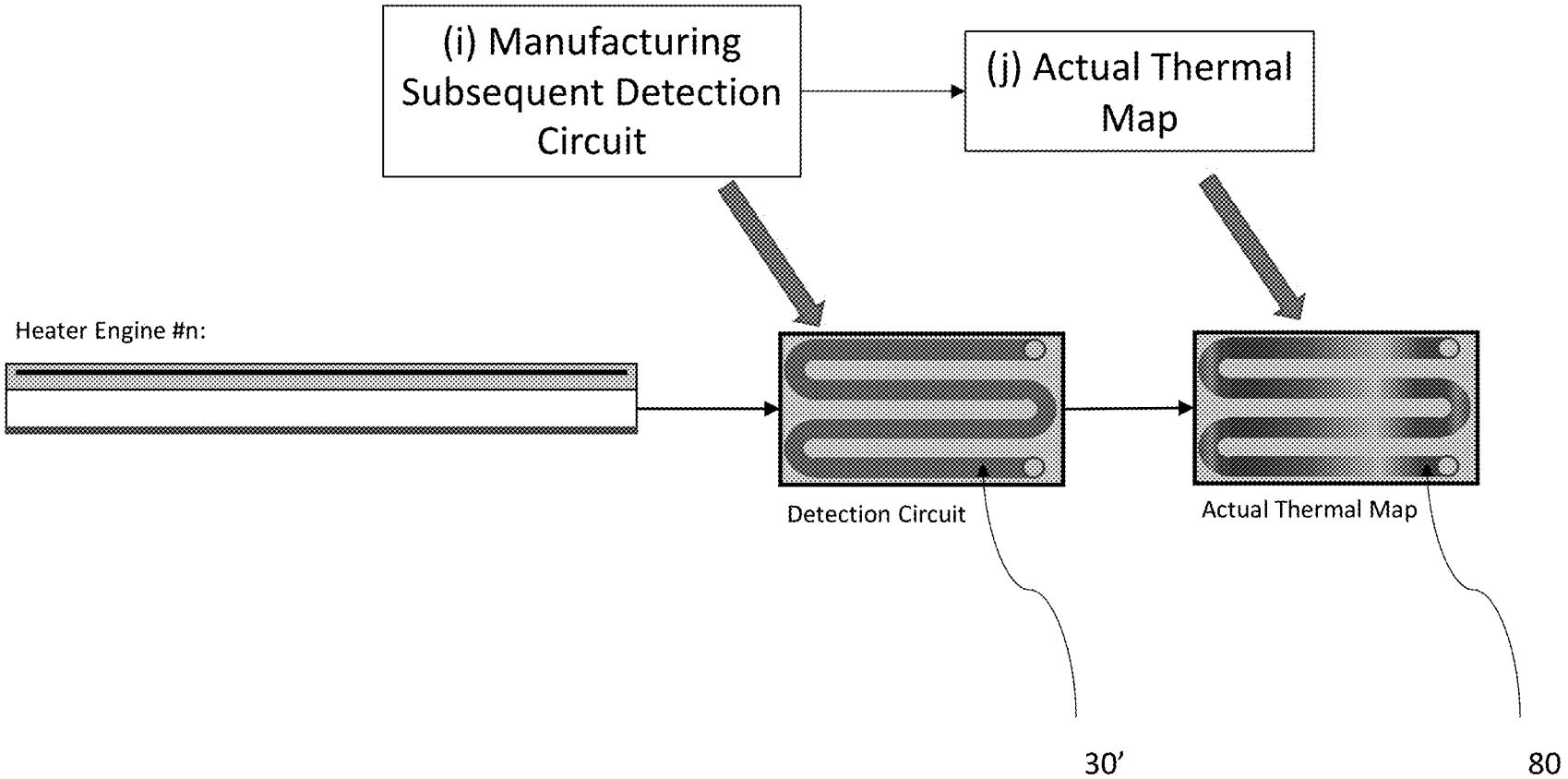
FIG. 7 is a schematic diagram illustrating further steps of a method of the present disclosure.

Referring now to FIG. 7, after it has been determined that the target surface 70 exhibits a desired temperature profile, the method proceeds to step (i), where a subsequent detection circuit 30' is manufactured, which in one form may be manufactured by a selective removal process as set forth above. Next, the method proceeds to step (j), where power is applied to the subsequent detection circuit 30', thereby obtaining an actual thermal map 80.

Figure 8:
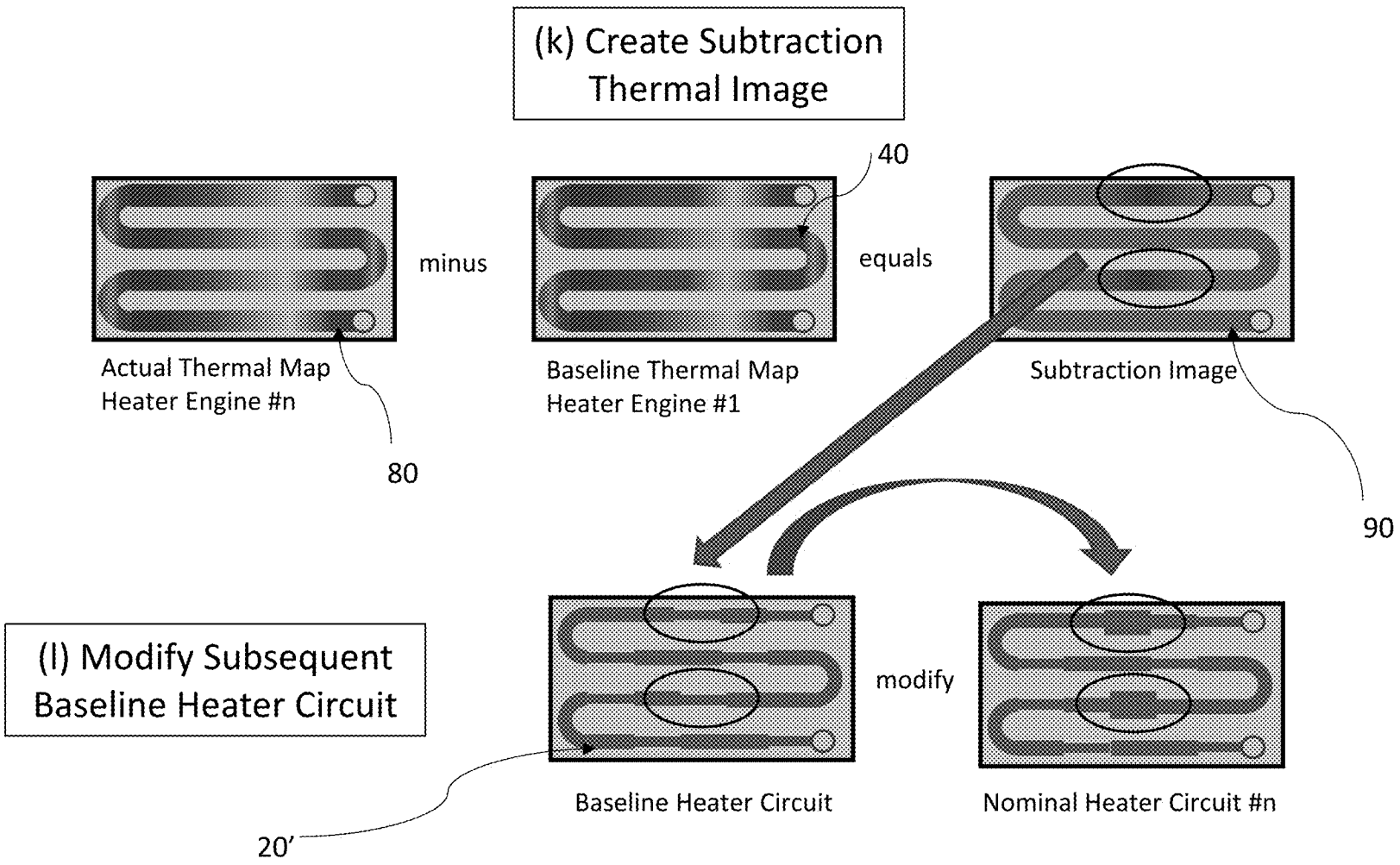
FIG. 8 is a schematic diagram illustrating still further steps of a method of the present disclosure.

As shown in FIG. 8, at step (k), the baseline thermal map 40 is subtracted from the actual thermal map 80 to create a subtraction thermal image 90. Then, at step (l), a subsequent baseline heater circuit 20' is modified according to the subtraction thermal image 90. More specifically, the subsequent baseline heater circuit 20' is modified by changing its sheet resistivity to a desired resistivity. The sheet resistivity change between the baseline heater circuit 20 and the subsequent baseline heater circuit 20' is calculated by:

$$\text{Sheet Resistivity Change} = \frac{T_{Heater_n} - T_{BaseHeater}}{T_{BaseHeater} - T_{ref}}$$

Where $T_{Heater_n}$ is the average trace temperature at each segment of the subsequent baseline heater circuit 20';

$T_{BaseHeater}$ is the average trace temperature at each segment of the base heater of the baseline heater circuit; and $T_{ref}$ is a reference temperature that depends on the test environment. If the heater is tested in an open-air environment, then $T_{ref}$ is the ambient temperature. If the heater is attached to a controlled cooling system, then $T_{ref}$ is the temperature of the cooling system. In one form, $T_{BaseHeater}$ and $T_{Heater}$ are obtained at the same $T_{ref}$.

Having calculated the sheet resistivity change, the trace width of the subsequent baseline heater circuit 20' can be calculated:

$$TraceWidth_{Heater_n} = \frac{TraceWidth_{BaseHeater}}{1 + \text{Sheet Resistivity Change}}$$

Where $\text{TraceWidth}_{BaseHeater}$ is the trace width of the baseline heater circuit at a particular location of the baseline heater circuit; and Sheet Resistivity Change is the output from the equation above.

The sheet resistivity can be modified, or the trace widths of the subsequent baseline heater circuit 20' can be modified to achieve a desired temperature profile similar or identical to the one developed at step (l). Processes under which the sheet resistivity can be modified include trimming the thickness of the subsequent baseline heater circuit or modifying the specific resistance. Such modifications of the widths or thicknesses can be effectuated with processes such as laser ablation, mechanical ablation (e.g., grinding, milling, microblasting), and hybrid waterjet. On the other hand, the widths/thicknesses can be increased by adding material to segments of the subsequent baseline heater circuit 20'. Alternatively, or in addition to the aforementioned processes, the sheet resistivity can be modified by modifying a specific resistivity of the subsequent baseline heater circuit 20' (for example, by modifying its microstructure through a heat treatment process, such as adding local oxides by a laser process). The resulting resistive heater exhibits the desired thermal map on the target surface 70 and any number n of subsequent thermal devices 60 can be subsequently consistently produced.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of manufacturing and adjusting a resistive heater comprising:

(a) designing a baseline heater circuit to be manufactured, the baseline heater circuit having a desired temperature profile;

(b) designing a detection circuit to be manufactured, the detection circuit having a constant trace watt density, the detection circuit being larger than the baseline heater circuit to allow a margin to be present between the detection circuit and the baseline heater circuit;

(c) manufacturing the detection circuit;

(d) applying power to the detection circuit and obtaining a baseline thermal map;

(e) removing a conductive material of the detection circuit by a selective removal process to form the baseline heater circuit;

(f) applying power to the baseline heater circuit and obtaining a nominal thermal map representing a temperature profile of the baseline heater circuit being manufactured;

(g) assembling the baseline heater circuit to a thermal device;

(h) applying power to the baseline heater circuit and obtaining a thermal map of a target surface;

repeating steps (a) through (h) until the thermal map of the target surface represents the desired temperature profile of the baseline heater circuit;

(i) manufacturing a subsequent detection circuit;

(j) applying power to the subsequent detection circuit and obtaining an actual thermal map;

(k) creating a subtraction thermal image which represents a temperature profile based on a temperature difference between the nominal thermal map and the actual thermal map; and (l) modifying a subsequent baseline heater circuit according to the subtraction thermal image.

2. The method according to claim 1, further comprising manufacturing a plurality of heaters by performing repeating steps (i) through (l).

3. The method according to claim 1, wherein the margin is 1% to 50% of a trace width of the base heater circuit.

4. The method according to claim 1, wherein the modifying a subsequent baseline heater circuit according to the subtraction thermal image is accomplished by at least one of changing a trace width of the subsequent baseline heater circuit, changing a thickness of the subsequent baseline heater circuit, modifying a specific resistivity of the subsequent baseline heater circuit by modifying its microstructure through a heat treatment process, adding different materials to segments of the subsequent baseline heater circuit, and combinations thereof.

5. The method according to claim 1, wherein the thermal maps are obtained by an IR camera.

6. The method according to claim 1, wherein the selective removal process is selected from a group consisting of laser ablation, mechanical ablation, and a hybrid waterjet.

7. The method according to claim 1, wherein the detection circuit is formed by thermal spraying.

8. The method according to claim 1, wherein the detection circuit is selected from the group consisting of layered, foil, and wire.

9. A method of manufacturing and adjusting a resistive heater comprising:

(a) designing a baseline heater circuit to be manufactured, the baseline heater circuit having a desired temperature profile;

(b) designing a detection circuit to be manufactured, the detection circuit having a constant trace watt density, the detection circuit being larger than the baseline heater circuit to allow a margin to be present between the detection circuit and the baseline heater circuit;

(c) manufacturing the detection circuit;

(d) applying power to the detection circuit and obtaining a baseline thermal map representing a temperature profile of the detection circuit;

(e) removing a conductive material of the detection circuit to form the baseline heater circuit;

(f) applying power to the baseline heater circuit and obtaining a nominal thermal map representing a temperature profile of the baseline heater circuit;

(g) assembling the baseline heater circuit to a thermal device;

(h) applying power to the baseline heater circuit and obtaining a thermal map of a target surface;

repeating steps (a) through (h) until the thermal map of the target surface represents the desired temperature profile of the baseline heater circuit;

(i) manufacturing a subsequent detection circuit;

(j) applying power to the subsequent detection circuit and obtaining an actual thermal map;

(k) creating a subtraction thermal image which represents a temperature profile based on a temperature difference between the nominal thermal map and the actual thermal map; and (l) modifying a subsequent baseline heater circuit according to the subtraction thermal image.

10. The method according to claim 9, wherein at least one of the detection circuit and the subsequent detection circuit are manufactured by applying a material, followed by using a selective removal process.

11. The method according to claim 9, wherein at least one of the baseline heater circuit and the subsequent baseline heater circuit are manufactured using a selective removal process.

12. The method according to claim 9, wherein the subsequent baseline heater circuit is modified by a selective removal process.

13. The method according to claim 9, further comprising manufacturing a plurality of heaters by performing steps (i) through (l).

14. A plurality of heater assemblies manufactured according to the method of claim 9.

15. The method according to claim 9, wherein the detection circuit is formed by thermal spraying.

16. The method according to claim 9, wherein the detection circuit is selected from the group consisting of layered, foil, and wire.

17. A method of manufacturing and adjusting a resistive heater comprising:

(a) manufacturing a detection circuit;

(b) applying power to the detection circuit and obtaining a baseline thermal map;

(c) removing a conductive material of the detection circuit to form a baseline heater circuit;

(d) applying power to the baseline heater circuit and obtaining a nominal thermal map representing a temperature profile of the baseline heater circuit being manufactured;

(e) assembling the baseline heater circuit to a thermal device;

(f) applying power to the baseline heater circuit and obtaining a thermal map of a target surface;

repeating steps (a) through (f) until the thermal map of the target surface represents a desired temperature profile of the baseline heater circuit;

(g) manufacturing a subsequent detection circuit;

(h) applying power to the subsequent detection circuit and obtaining an actual thermal map;

(i) creating a subtraction thermal image which represents a temperature profile based on a temperature difference between the nominal thermal map and the actual thermal map; and (j) modifying a subsequent baseline heater circuit according to the subtraction thermal image.

18. The method according to claim 17, wherein at least one of the baseline heater circuit and the detection circuit is manufactured or modified by a selective removal process.

19. The method according to claim 17, wherein the detection circuit is formed by thermal spraying.

20. The method according to claim 17, wherein the detection circuit is selected from the group consisting of layered, foil, and wire.

* * * * *